US011982042B2

(12) United States Patent
Bodine et al.

(10) Patent No.: US 11,982,042 B2
(45) **Date of Patent: *May 14, 2024**

(54) LAUNDRY TREATING APPLIANCE HAVING A DOOR ASSEMBLY

(71) Applicant: WHIRLPOOL CORPORATION, Benton Harbor, MI (US)

(72) Inventors: Darryl C. Bodine, St. Joseph, MI (US); Gregg P. Fitzgerald, Eau Claire, MI (US); Stephen D. Ostdiek, St. Joseph, MI (US); Marcel Schmidt, Poprad (SK); Todd Tunzi, St. Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/563,248

(22) Filed: Dec. 28, 2021

(65) Prior Publication Data

US 2022/0120025 A1 Apr. 21, 2022

Related U.S. Application Data

(62) Division of application No. 16/665,718, filed on Oct. 28, 2019, now Pat. No. 11,242,645.

(60) Provisional application No. 62/768,292, filed on Nov. 16, 2018.

(51) Int. Cl.

| | |
|---|---|
| ***D06F 39/14*** | (2006.01) |
| ***D06F 23/06*** | (2006.01) |
| ***D06F 37/10*** | (2006.01) |

(52) U.S. Cl.
CPC ..... *D06F 39/14* (2013.01); *D06F 23/06* (2013.01); *D06F 37/10* (2013.01)

(58) Field of Classification Search
CPC ..... D06F 23/06; D06F 37/10; D06F 39/14
See application file for complete search history.

(56) References Cited

U.S. PATENT DOCUMENTS

| | | | |
|---|---|---|---|
| 6,256,823 | B1 | 7/2001 | Kronbetter et al. |
| 7,958,756 | B2 | 6/2011 | Gracia Bobed |
| 8,261,582 | B2 | 9/2012 | Graute et al. |
| 8,826,701 | B2 | 9/2014 | Hong et al. |
| 9,856,593 | B2 | 1/2018 | Wishney et al. |
| 9,869,048 | B2 | 1/2018 | Burgess et al. |
| 2008/0302141 | A1 | 12/2008 | Chung |
| 2014/0157673 | A1 | 6/2014 | Bazzinotti |
| 2015/0019017 | A1 | 1/2015 | Bodine et al. |
| 2015/0292135 | A1 | 10/2015 | Wishney et al. |
| 2016/0369445 | A1 | 12/2016 | Kim et al. |
| 2017/0137985 | A1 | 5/2017 | Kim |

(Continued)

FOREIGN PATENT DOCUMENTS

| | | |
|---|---|---|
| EP | 1285986 B1 | 7/2004 |
| EP | 2415920 B1 | 5/2013 |

(Continued)

*Primary Examiner* — Joseph L. Perrin
(74) *Attorney, Agent, or Firm* — McGarry Bair PC

(57) ABSTRACT

A laundry treating appliance includes a chassis defining an interior and having a front panel defining a front panel opening. A rotatable treating chamber is located within the interior and accessible through the front panel opening. A door assembly is mounted to the chassis for movement between opened and closed positions to selectively open or close the front panel opening. The door assembly includes a window or panel slidable between first and second positions.

20 Claims, 9 Drawing Sheets

(56) References Cited

U.S. PATENT DOCUMENTS

| | | | |
|---|---|---|---|
| 2017/0248926 | A1 | 8/2017 | Bodine et al. |
| 2018/0038040 | A1 | 2/2018 | Kim et al. |
| 2018/0073178 | A1 | 3/2018 | Wishney et al. |
| 2018/0073182 | A1 | 3/2018 | Burgess et al. |
| 2018/0092507 | A1 | 4/2018 | Wilson |
| 2018/0340286 | A1 | 11/2018 | Kim et al. |

FOREIGN PATENT DOCUMENTS

| | | | |
|---|---|---|---|
| EP | 2746447 | A1 | 6/2014 |
| EP | 3293300 | A1 | 3/2018 |
| EP | 3296445 | A1 | 3/2018 |
| JP | 2017051215 | A | 3/2017 |
| KR | 100608259 | B1 | 8/2006 |

LAUNDRY TREATING APPLIANCE HAVING A DOOR ASSEMBLY

CROSS-REFERENCE TO RELATED APPLICATIONS

This application is a divisional application of U.S. patent application Ser. No. 16/665,718, filed Oct. 28, 2019, now U.S. Pat. No. 11,242,645, issued Feb. 8, 2022, which claims the benefit of U.S. Provisional Patent Application No. 62/768,292, filed on Nov. 16, 2018, both of which are incorporated herein by reference in their entirety.

BACKGROUND

Laundry treating appliances, such as clothes washers, clothes dryers, refreshers, and non-aqueous systems, can have a configuration based on a rotating laundry basket or drum that defines a drum opening and a treating chamber in which laundry items are placed for treating according to one or more cycles of operation. The laundry treating appliance can include a cabinet including a panel with an access opening through which clothes are loaded and unloaded into the treating chamber. A door assembly can be movably mounted to the cabinet to selectively open and close the access opening to the treating chamber. The door assembly can include multiple door components, such as a transparent or partially transparent viewing window, a hinge assembly, and a user interface for the laundry treating appliance. A bellows can be provided to extend at least partially between the access opening and the drum opening.

BRIEF SUMMARY

In one aspect, the present disclosure relates to a laundry treating appliance comprising a chassis defining an interior and having a front panel defining a front panel opening, a rotatable treating chamber located within the interior and having a treating chamber opening at a lower height than the front panel opening, yet still accessible through the front panel opening, and a door assembly mounted to the chassis for movement between opened and closed positions to selectively open or close the front panel opening and movable from the closed position to the opened position from within the treating chamber, the door assembly comprising a window aligned with the front panel opening when the door assembly is in the closed position, and the window is slidable between a closed position, where it closes the front panel opening, and an opened position, where it provides access to the front panel opening.

In another aspect, the present disclosure relates to a laundry treating appliance comprising a chassis defining an interior and having a front panel defining a front panel opening, a rotatable treating chamber located within the interior and having a treating chamber opening at a lower height than the front panel opening, yet still accessible through the front panel opening, and a door assembly mounted to the chassis for movement between opened and closed positions to selectively open or close the front panel opening and movable from the closed position to the opened position from within the treating chamber, the door assembly comprising a window aligned with the front panel opening when the door assembly is in the closed position, and the window is slidable between a closed position, where it closes the front panel opening, and an opened position, where it provides access to the front panel opening.

DETAILED DESCRIPTION

Figure 1:
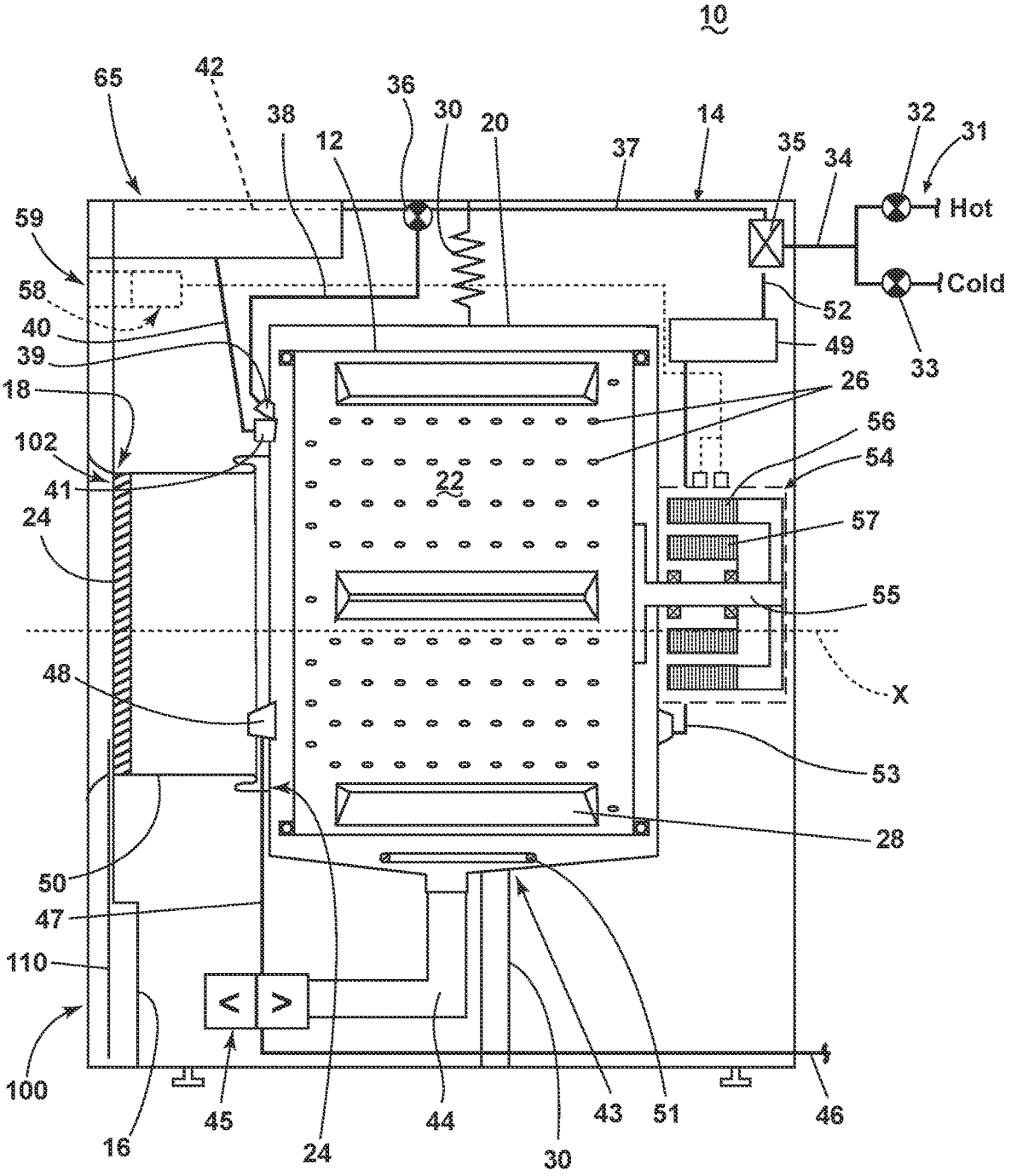
FIG. 1 is a schematic cross-sectional view of a laundry treating appliance including a door assembly in a closed condition.

FIG. 1 is a schematic view of a laundry treating appliance 10 according to aspects of the present disclosure. The laundry treating appliance 10 can be any appliance which performs a cycle of operation to clean or otherwise treat items placed therein, non-limiting examples of which include a horizontal or vertical axis clothes washer; a clothes dryer; a combination washing machine and dryer; a dispensing dryer; a tumbling or stationary refreshing/revitalizing machine; an extractor; a non-aqueous washing apparatus; and a revitalizing machine. While the laundry treating appliance 10 of FIG. 1 is illustrated as a horizontal axis, front-load laundry treating appliance 10, the aspects of the present disclosure can have applicability in laundry treating appliances with other configurations. Depending on the configuration, it is possible for the aspects of the present disclosure to have applicability in other appliances having a door, whether it be hinged, slidable, or otherwise attached to a cabinet, with access to a treating chamber.

Laundry treating appliances are typically categorized as either a vertical axis laundry treating appliance or a horizontal axis laundry treating appliance. As used herein, the term "horizontal axis" laundry treating appliance refers to a laundry treating appliance having a rotatable drum that rotates about a generally horizontal axis relative to a surface that supports the laundry treating appliance. The drum can rotate about the axis inclined relative to the horizontal axis, with fifteen degrees of inclination being one example of the inclination. Similar to the horizontal axis laundry treating appliance, the term "vertical axis" laundry treating appliance refers to a laundry treating appliance having a rotatable drum that rotates about a generally vertical axis relative to a surface that supports the laundry treating appliance. However, the rotational axis need not be perfectly vertical to the surface. The drum can rotate about an axis inclined relative to the vertical axis, with fifteen degrees of inclination being one example of the inclination.

In another aspect, the terms vertical axis and horizontal axis are often used as shorthand terms for the manner in which the appliance imparts mechanical energy to the laundry, even when the relevant rotational axis is not absolutely vertical or horizontal. As used herein, the "vertical axis" laundry treating appliance refers to a laundry treating appliance having a rotatable drum, perforate or imperforate, that holds fabric items and, optionally, a clothes mover, such as an agitator, impeller, nutator, and the like within the drum. The clothes mover can move within the drum to impart mechanical energy directly to the clothes or indirectly through wash liquid in the drum. The clothes mover can typically be moved in a reciprocating rotational movement. In some vertical axis laundry treating appliances, the drum rotates about a vertical axis generally perpendicular to a surface that supports the laundry treating appliance. However, the rotational axis need not be vertical. The drum can rotate about an axis inclined relative to the vertical axis.

As used herein, the "horizontal axis" laundry treating appliance refers to a laundry treating appliance having a rotatable drum, perforated or imperforate, that holds laundry items and washes and/or dries the laundry items. In some horizontal axis laundry treating appliances, the drum rotates about a horizontal axis generally parallel to a surface that supports the laundry treating appliance. However, the rotational axis need not be horizontal. The drum can rotate about an axis inclined or declined relative to the horizontal axis. In horizontal axis laundry treating appliances, the clothes are lifted by the rotating drum and then fall in response to gravity to form a tumbling action. Mechanical energy is imparted to the clothes by the tumbling action formed by the repeated lifting and dropping of the clothes. Vertical axis and horizontal axis machines are best differentiated by the manner in which they impart mechanical energy to the fabric articles.

Regardless of the axis of rotation, a laundry treating appliance can be top-loading or front-loading. In a top-loading laundry treating appliance, laundry items are placed into the drum through an access opening in the top of a cabinet, while in a front-loading laundry treating appliance laundry items are placed into the drum through an access opening in the front of a cabinet. If a laundry treating appliance is a top-loading horizontal axis laundry treating appliance or a front-loading vertical axis laundry treating appliance, an additional access opening is located on the drum.

In more detail, the laundry treating appliance 10 of FIG. 1 is illustrated as a horizontal-axis laundry treating appliance 10, which can include a structural support system including a cabinet 14, which defines a housing within which a laundry holding system resides. The cabinet 14 can be a housing having a chassis and/or a frame, to which decorative panels can or cannot be mounted, defining an interior enclosing components typically found in a conventional laundry treating appliance, such as an automated clothes washer or dryer, which can include motors, pumps, fluid lines, controls, sensors, transducers, and the like. Such components will not be described further herein except as necessary for a complete understanding of the present disclosure. The cabinet 14 can include a front panel 16 that defines a front panel opening 18 to allow user access to the interior of the cabinet 14.

The laundry holding system of the illustrated laundry treating appliance 10 can include a tub 20 supported within the cabinet 14 by a suitable suspension system, the tub 20 at least partially defining a treating chamber 22 for laundry items. A drum 12 can be provided within the tub 20 to further define at least a portion of the treating chamber 22. The treating chamber 22 is configured to receive a laundry load comprising laundry items for treatment, including, but not limited to, a hat, a scarf, a glove, a sweater, a blouse, a shirt, a pair of shorts, a dress, a sock, and a pair of pants, a shoe, an undergarment, and a jacket. The front panel opening 18 can provide access to the treating chamber 22. The drum 12 can be either imperforate or perforated, including a plurality of perforations 26 such that liquid can flow between the tub 20 and the drum 12 through the perforations 26. A plurality of baffles 28 can be disposed on an inner surface of the drum 12 to lift the laundry load received in the treating chamber 22 while the drum 12 rotates. It will be understood that it is also within the scope of the present disclosure for the laundry holding system to comprise only the tub 20, without a drum, to define the treating chamber 22. The laundry treating appliance 10 can further include a suspension system 30 for dynamically suspending the laundry holding system within the structural support system.

The tub 20 can also define a tub opening 24, which can be thought of as a treating chamber opening and which can be at least partially aligned with the front panel opening 18 of the cabinet 14. In one example, the tub 20, along with the tub opening 24, the drum 12, and the front panel opening 18 can have central axes that are co-axial with one another, or with at least one of the other axes, such that a common central axis X is formed. Optionally, and especially in the case that the laundry treating appliance 10 is provided as a washing machine, rather than a clothes dryer, a bellows 50 can extend between the tub opening 24 and the front panel opening 18 to couple the front panel opening 18 of the cabinet 14 with the tub opening 24 of the tub 20. The bellows 50 can sealingly couple the tub opening 24 and the front panel opening 18 such that liquid is not permitted to move from the tub 20 into the interior of the cabinet 14.

A door assembly 100 can be included with the laundry treating appliance 10. The door assembly 100 can be movably mounted or coupled to the cabinet 14. By way of non-limiting example, the door assembly 100 can be hingedly coupled to the cabinet 14 for movement between an opened condition (FIG. 2) and a closed condition as shown. In the closed condition, the door assembly 100 can seal against the front panel opening 18 or the bellows 50 and can be coextensive with and prevent access to the front panel 16. In the opened condition, the door assembly 100 can be spaced apart from the front panel opening 18 and the bellows 50 and can allow access to the front panel 16. The door assembly 100 can include an access opening 102 through which the treating chamber 22 can be selectively accessed. A window panel 110 can be movably coupled with the door assembly 100 for movement between a lowered, or opened, position and a raised, or closed, position and coextensive with the access opening 102 to selectively allow access to the treating chamber 22 through the access opening 102, without the need to open/close the door assembly 100. In one example, the window panel 110 can be entirely slidably received within the door assembly 100 for movement between the lowered position and the raised position. The door assembly 100 can further comprise a front fascia. By way of non-limiting example, when the laundry treating appliance 10 is a washing machine and the bellows 50 is included, the door assembly 100, and specifically the window panel 110, can align with and seal against the bellows 50. When the laundry treating appliance 10 is a clothes dryer, in which the bellows 50 may not be included, the door assembly 100, and specifically the window panel 110, can align with and seal against the front panel opening 18, with an optional seal, such as a gasket seal, provided between the door assembly 100 and the front panel opening 18.

Optionally, and, for example, in the case that the laundry treating appliance 10 is provided as a washing machine, the laundry treating appliance 10 can further include a liquid supply system for supplying water to the laundry treating appliance 10 for use in treating laundry during a cycle of operation. The liquid supply system can include a source of water, such as a household water supply 31, which can include separate valves 32 and 33 for controlling the flow of hot and cold water, respectively. Water can be supplied through an inlet conduit 34 directly to the tub 20 by controlling first and second diverter mechanisms 35 and 36, respectively. The diverter mechanisms 35, 36 can be a diverter valve having two outlets such that the diverter mechanisms 35, 36 can selectively direct a flow of liquid to one or both of two flow paths. Water from the household water supply 31 can flow through the inlet conduit 34 to the first diverter mechanism 35 which can direct the flow of liquid to a supply conduit 37. The second diverter mechanism 36 on the supply conduit 37 can direct the flow of liquid to a tub outlet conduit 38 which can be provided with a spray nozzle 39 configured to spray the flow of liquid into the tub 20. In this manner, water from the household water supply 31 can be supplied directly to the tub 20. While the valves 32, 33 and the conduit 34 are illustrated exteriorly of the cabinet 14, it will be understood that these components can be internal to the cabinet 14.

The laundry treating appliance 10 can also optionally be provided with a dispensing system for dispensing treating chemistry to the treating chamber 22 for use in treating the laundry according to a cycle of operation. The dispensing system can include a treating chemistry dispenser 65 which can be a single dose dispenser, a bulk dispenser, or an integrated single dose and bulk dispenser and is fluidly coupled to the treating chamber 22. The treating chemistry dispenser 65 can be configured to dispense a treating chemistry directly to the tub 20 or mixed with water from the liquid supply system through a dispensing outlet conduit 40. The dispensing outlet conduit 40 can include a dispensing nozzle 41 configured to dispense the treating chemistry into the tub 20 in a desired pattern and under a desired amount of pressure. For example, the dispensing nozzle 41 can be configured to dispense a flow or stream of treating chemistry into the tub 20 by gravity, i.e. a non-pressurized stream. Water can be supplied to the treating chemistry dispenser 65 from the supply conduit 37 by directing the diverter mechanism 36 to direct the flow of water to a dispensing supply conduit 42.

The treating chemistry dispenser 65 can include multiple chambers or reservoirs fluidly coupled to the treating chamber 22 for receiving doses of different treating chemistries. The treating chemistry dispenser 65 can be implemented as a dispensing drawer that is slidably received within the cabinet 14, or within a separate dispenser housing which can be provided in the cabinet 14. The treating chemistry dispenser 65 can be moveable between a fill position, where the treating chemistry dispenser 65 is exterior to the cabinet 14 and can be filled with treating chemistry, and a dispense position, where the treating chemistry dispenser 65 is interior of the cabinet 14.

Non-limiting examples of treating chemistries that can be dispensed by the dispensing system during a cycle of operation include one or more of the following: water, enzymes, fragrances, stiffness/sizing agents, wrinkle releasers/reducers, softeners, antistatic or electrostatic agents, stain repellants, water repellants, energy reduction/extraction aids, antibacterial agents, medicinal agents, vitamins, moisturizers, shrinkage inhibitors, and color fidelity agents, and combinations thereof.

The laundry treating appliance 10 can also optionally include a recirculation and drain system for optionally recirculating liquid within the laundry holding system and for draining liquid from the laundry treating appliance 10. Liquid supplied to the tub 20 through tub outlet conduit 38 and/or the conduit 40 typically enters a space between the tub 20 and the drum 12 and can flow by gravity to a sump 43 formed in part by a lower portion of the tub 20. The sump 43 can also be formed by a sump conduit 44 that can fluidly couple the lower portion of the tub 20 to a pump 45. The pump 45 can direct liquid to a drain conduit 46, which can drain the liquid from the laundry treating appliance 10, or to a recirculation conduit 47, which can terminate at a recirculation inlet 48. The recirculation inlet 48 can direct the liquid from the recirculation conduit 47 into the drum 12. The recirculation inlet 48 can introduce the liquid into the drum 12 in any suitable manner, such as by spraying, dripping, or providing a steady flow of liquid. In this manner, liquid provided to the tub 20, with or without treating chemistry, can be recirculated into the treating chamber 22 for treating the laundry within.

The liquid supply and/or recirculation and drain system can be provided with a heating system which can include one or more devices for heating laundry and/or liquid supplied to the tub 20, such as a steam generator 49 and/or a sump heater 51. Liquid from the household water supply 31 can be provided to the steam generator 49 through the inlet conduit 34 by controlling the first diverter mechanism 35 to direct the flow of liquid to a steam supply conduit 52. Steam generated by the steam generator 49 can be supplied to the tub 20 through a steam outlet conduit 53. The steam generator 49 can be any suitable type of steam generator 49 such as a flow through steam generator or a tank-type steam generator. Alternatively, the sump heater 51 can be used to generate steam in place of or in addition to the steam generator 49. In addition or alternatively to generating steam, the steam generator 49 and/or sump heater 51 can be used to heat the laundry and/or liquid within the tub 20 as part of a cycle of operation.

It is noted that the illustrated suspension system, liquid supply system, recirculation and drain system, and dispensing system are shown for exemplary purposes only and are not limited to the systems shown in the drawings and described above. For example, the liquid supply, dispensing, and recirculation and pump systems can differ from the configuration shown in FIG. 1, such as by inclusion of other valves, conduits, treating chemistry dispensers, sensors, such as water level sensors and temperature sensors, and the like, to control the flow of liquid through the laundry treating appliance 10 and for the introduction of more than one type of treating chemistry. For example, the liquid supply system can include a single valve for controlling the flow of water from the household water source. In another example, the recirculation and pump system can include two separate pumps for recirculation and draining, instead of the single pump as previously described.

The laundry treating appliance 10 also includes a drive system for rotating the drum 12 within the tub 20. The drive system can include a motor 54 for rotationally driving the drum 12. The motor 54 can be directly coupled with the drum 12 through a drive shaft 55 to rotate the drum 12 about a rotational axis during a cycle of operation. The motor 54 can be a brushless permanent magnet (BPM) motor having a stator 56 and a rotor 57. Alternately, the motor 54 can be coupled with the drum 12 through a belt and a drive shaft to rotate the drum 12, as is known in the art. Other motors, such as an induction motor or a permanent split capacitor (PSC) motor, can also be used. The motor 54 can rotationally drive the drum 12 including that the motor 54 can rotate the drum 12 at various speeds in either rotational direction.

The control system can control the operation of the laundry treating appliance 10 to implement one or more cycles of operation. The control system can include a controller 58 located within the cabinet 14 and a user interface 59 that can be operably coupled with the controller 58. The user interface 59 can provide an input and output function for the controller. The user interface 59 can include one or more knobs, dials, switches, displays, touchscreens, and the like for communicating with the user, such as to receive input and provide output. For example, the displays can include any suitable communication technology including that of a liquid crystal display (LCD), a light-emitting diode (LED) array, or any suitable display that can convey a message to the user. The user can enter different types of information including, without limitation, cycle selection, and cycle parameters, such as cycle options. Other communications paths and methods can also be included in the laundry treating appliance 10 and can allow the controller 58 to communicate with the user in a variety of ways. For example, the controller 58 can be configured to send a text message to the user, send an electronic mail to the user, or provide audio information to the user either through the laundry treating appliance 10 or utilizing another device such as a mobile phone.

The controller 58 can include the machine controller and any additional controllers provided for controlling any of the components of the laundry treating appliance 10. For example, the controller 58 can include the machine controller and a motor controller. Many known types of controllers can be used for the controller 58. The specific type of controller is not germane to the present disclosure. It is contemplated that the controller can be a microprocessor-based controller that implements control software and sends/receives one or more electrical signals to/from each of the various working components to effect the control software. As an example, proportional control (P), proportional integral control (PI), and proportional derivative control (PD), or a combination thereof, a proportional integral derivative control (PID control), can be used to control the various components.

Figure 2:
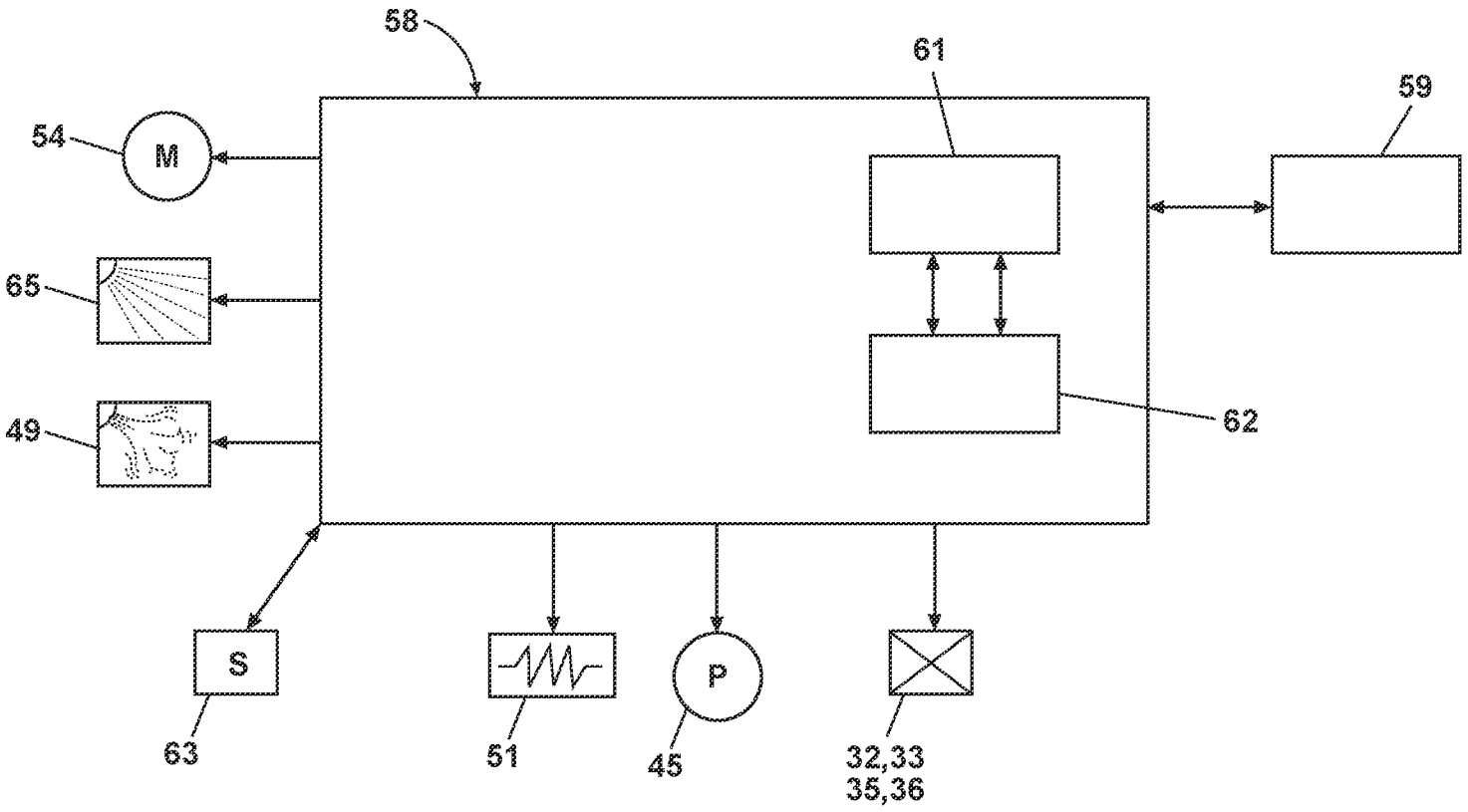
FIG. 2 is a schematic representation of a control system for controlling the operation of the laundry treating appliance of FIG. 1.

As illustrated in FIG. 2, the controller 58 can be provided with a memory 61 and a central processing unit (CPU) 62. The memory 61 can be used for storing the control software that can be executed by the CPU 62 in completing a cycle of operation using the laundry treating appliance 10 and any additional software. For example, the memory 61 can store a set of executable instructions including at least one user-selectable cycle of operation. Examples, without limitation, of cycles of operation include: wash, heavy duty wash, delicate wash, quick wash, pre-wash, refresh, rinse only, and timed wash. The memory 61 can also be used to store information, such as a database or table, and to store data received from one or more components of the laundry treating appliance 10 that can be communicably coupled with the controller 58. The database or table can be used to store the various operating parameters for the one or more cycles of operation, including factory default values for the operating parameters and any adjustments to them by the control system or by user input.

The controller 58 can be operably coupled with one or more components of the laundry treating appliance 10 for communicating with and controlling the operation of the component to complete a cycle of operation. For example, the controller 58 can be operably coupled with the motor 54, the pump 45, the treating chemistry dispenser 65, the steam generator 49 and the sump heater 51 to control the operation of these and other components to implement one or more of the cycles of operation The controller 58 can also be coupled with one or more sensors 63 provided in one or more of the systems of the laundry treating appliance 10 to receive input from the sensors 63, which are known in the art and not shown for simplicity. Non-limiting examples of sensors 63 that can be communicably coupled with the controller 58 include: a treating chamber temperature sensor, a moisture sensor, a weight sensor, a chemical sensor, a position sensor, an imbalance sensor, a load size sensor, and a motor torque sensor, which can be used to determine a variety of system and laundry characteristics, such as laundry load inertia or mass.

Figure 3:
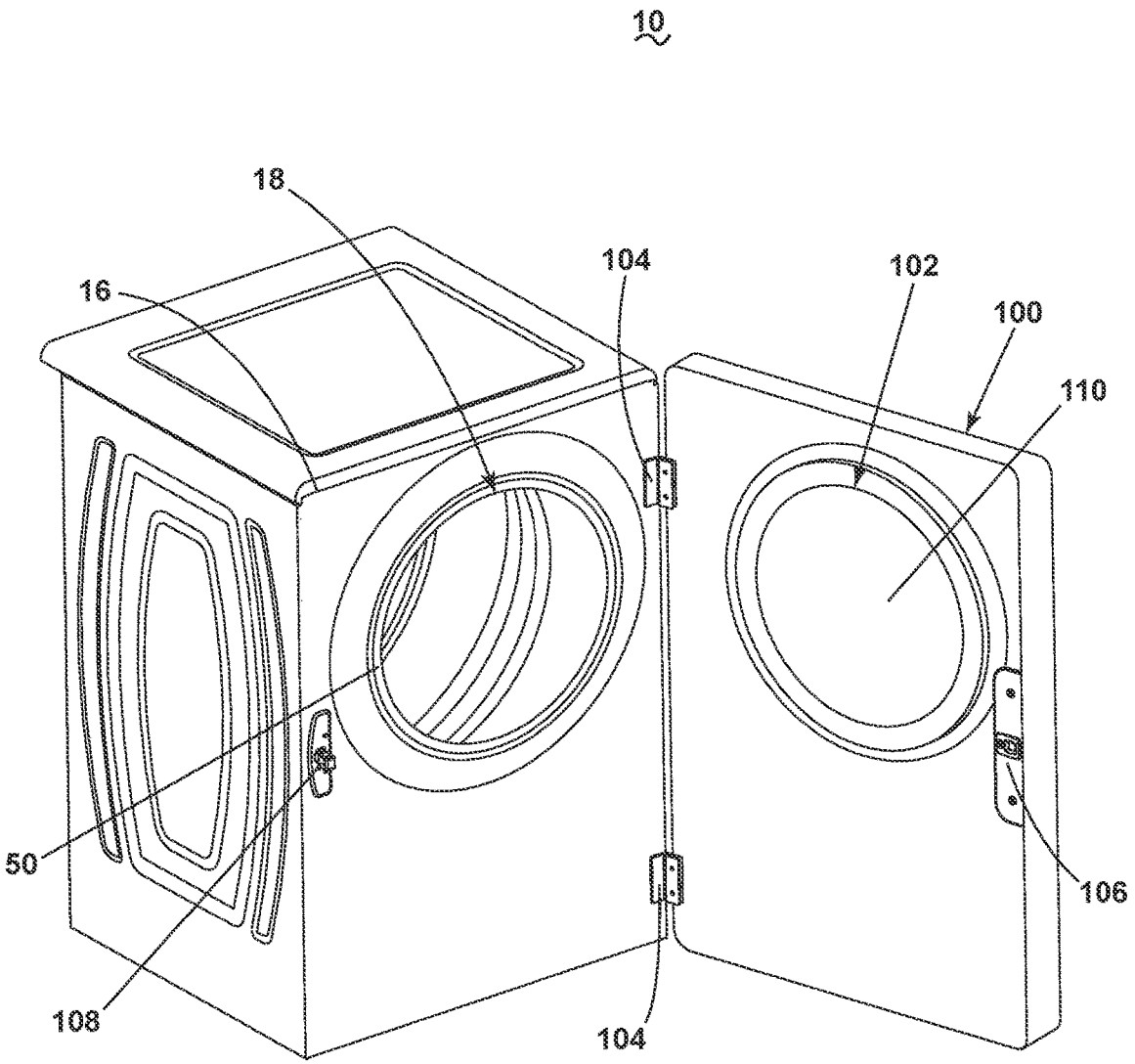
FIG. 3 is a perspective view of the laundry treating appliance of FIG. 1 with the door assembly in an opened condition.

FIG. 3 illustrates a perspective view of the laundry treating appliance 10 with the door assembly 100 in the opened condition, exposing the front panel 16 of the cabinet 14 to view by a user. At least one hinge 104 can couple the door assembly 100 to the cabinet 14 for movement between the closed condition and the opened condition. While the door assembly 100 is illustrated herein as pivoting horizontally, it will be understood that the door assembly 100 can also be configured to pivot vertically. Any suitable closure mechanism can be used for securing the door assembly 100 in the closed condition. By way of non-limiting example, a catch or hook 108 can be provided on the front panel 16 for selective interaction with a latch 106 provided on the door assembly 100. The latch 106 and the hook 108 can be configured to resiliently retain the door assembly 100 in the closed condition until sufficient force is applied to overcome the coupling of the latch 106 and the hook 108.

In the case that the window panel 110 is slidably moveable within the door assembly 100, as illustrated herein, the hinged movement of the door assembly 100 relative to the cabinet 14 can serve to satisfy Underwriters Laboratories (UL) safety standards. The window panel 110 can be configured such that a user lowers the window panel 110 entirely to the lowered position in order to load laundry items into the treating chamber 22 through the entire access opening 102 and brings the window panel 110 to the raised position when loading has been completed and in preparation for the cycle of operation. Additionally, the door assembly 100 can be opened by applying a pushing force or pressure from within the treating chamber 22 or pulling force or pressure from an exterior of the laundry treating appliance 10 on the door assembly 100 to move the door assembly 100 from the closed condition to the opened condition. In this way, the desired user experience of loading laundry items into the treating chamber 22 via the slidable window panel 110 can be preserved, while still satisfying safety standards by the provision of the hingedly movable door assembly 100.

In one example, the bellows 50 can protrude slightly beyond the front panel opening 18 such that the bellows 50 can contact and resiliently bear against the door assembly 100 when the door assembly 100 is in the closed condition to provide a sealing engagement between the bellows 50 and the door assembly 100. In one specific example, the bellows 50 can resiliently bear against the window panel 110 when the door assembly 100 is in the closed condition and the window panel 110 is in the raised position. Alternately, the bellows 50 can resiliently bear against the door assembly 100 outside of the circumference of the window panel 110 such that the bellows 50 seals against the door assembly 100 regardless of whether the window panel 110 is in the raised position or the lowered position. When a bellows 50 is not provided with the laundry treating appliance 10, a gasket seal can resiliently bear against the window panel 110 when the door assembly 100 is in the closed condition and the window panel 110 is in the raised position.

Figure 4:
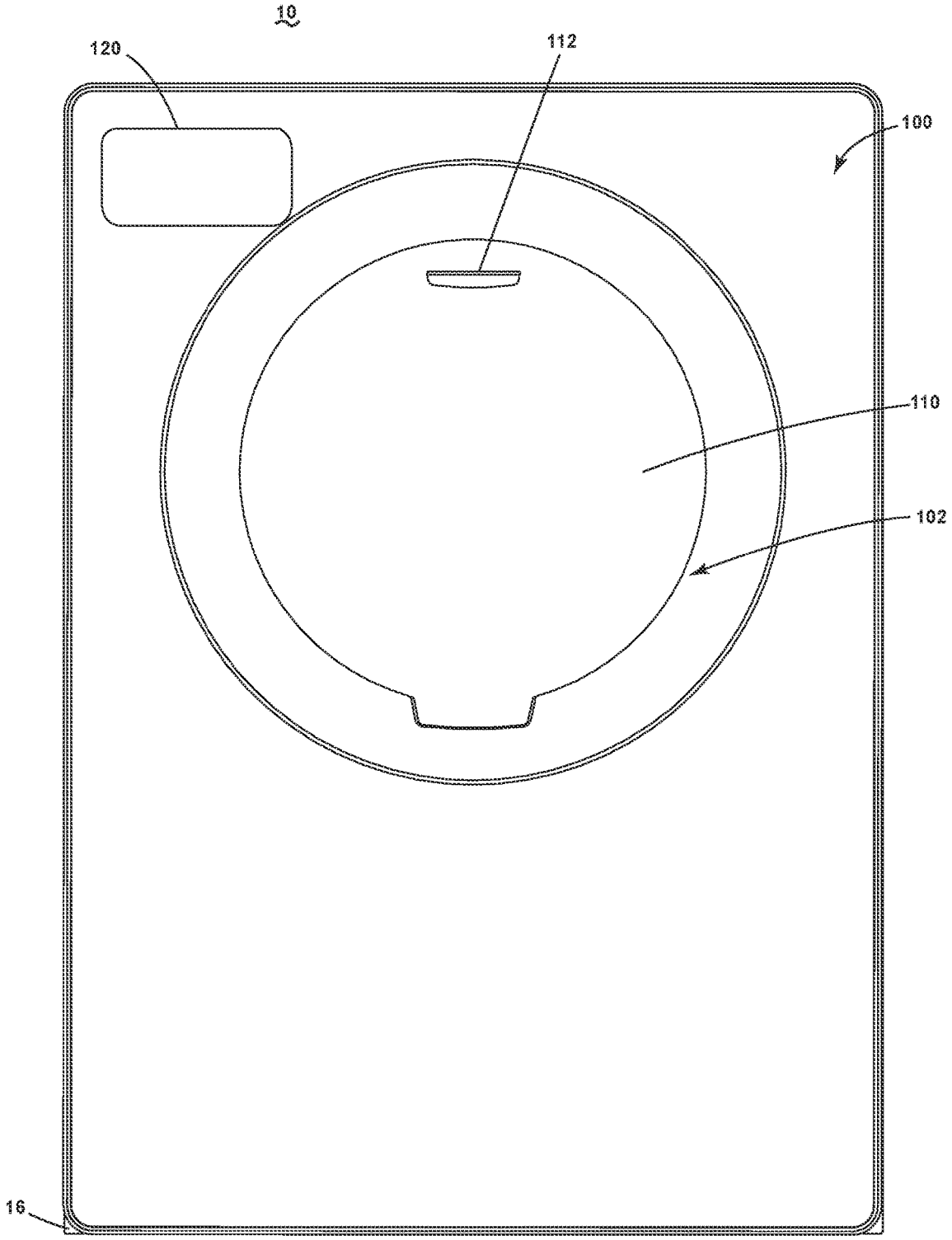
FIG. 4 is a front view of the laundry treating appliance of FIG. 1 with the door assembly in the closed condition and a window in a raised position.

FIG. 4 illustrates a front view of the laundry treating appliance 10 and the door assembly 100 in the closed condition. In this view, the window panel 110 is in the raised position, closing the access opening 102 and the front panel opening 18, and preventing user access to the treating chamber 22. The door assembly 100 can further, and optionally, include a treating chemistry dispenser receiving portion 120 through which the user can access the treating chemistry dispenser 65. In one example, the treating chemistry dispenser receiving portion 120 can be provided as an opening in the door assembly 100 through which the treating chemistry dispenser 65 can be slidably withdrawn for access by the user. Other components, though not shown, can be included on or within the door assembly 100, non-limiting examples of which include the user interface 59, a display, or mode selectors. In the case that such components are provided with the door assembly 100 requiring electrical power, the wires for powering such components can pass from the cabinet 14 into the door assembly 100 by passing through the at least one hinge 104.

The window panel 110 can include a see-through panel or window, as well as a grip or a handle 112. The window panel 110 can be formed of glass, plastic, or other suitable material. It will also be understood that the window panel 110 can include multiple sliding panels, including an outer panel that can be configured to protect the user from the motion of the drum or tub 20 and an inner panel that seals the treating chamber 22. The handle 112 can provide an outwardly or inwardly protruding formation that a user can grip in order to slide the window panel 110 between the raised and lowered positions. When the window panel 110 is in the raised position, the window panel 110 can be held in the raised position by any suitable latching mechanism, non-limiting examples of which include a snap fit or an interference grip. It will be understood that the window panel 110 can be slid in any suitable manner, including through the use of tracks or through an electrical sliding mechanism. Further, the window panel 110 can be slid in any suitable direction to open and close the access opening 102 of the treating chamber 22, including that the window panel 110 can be slid sideways, downwards, or upwards.

Figure 5:
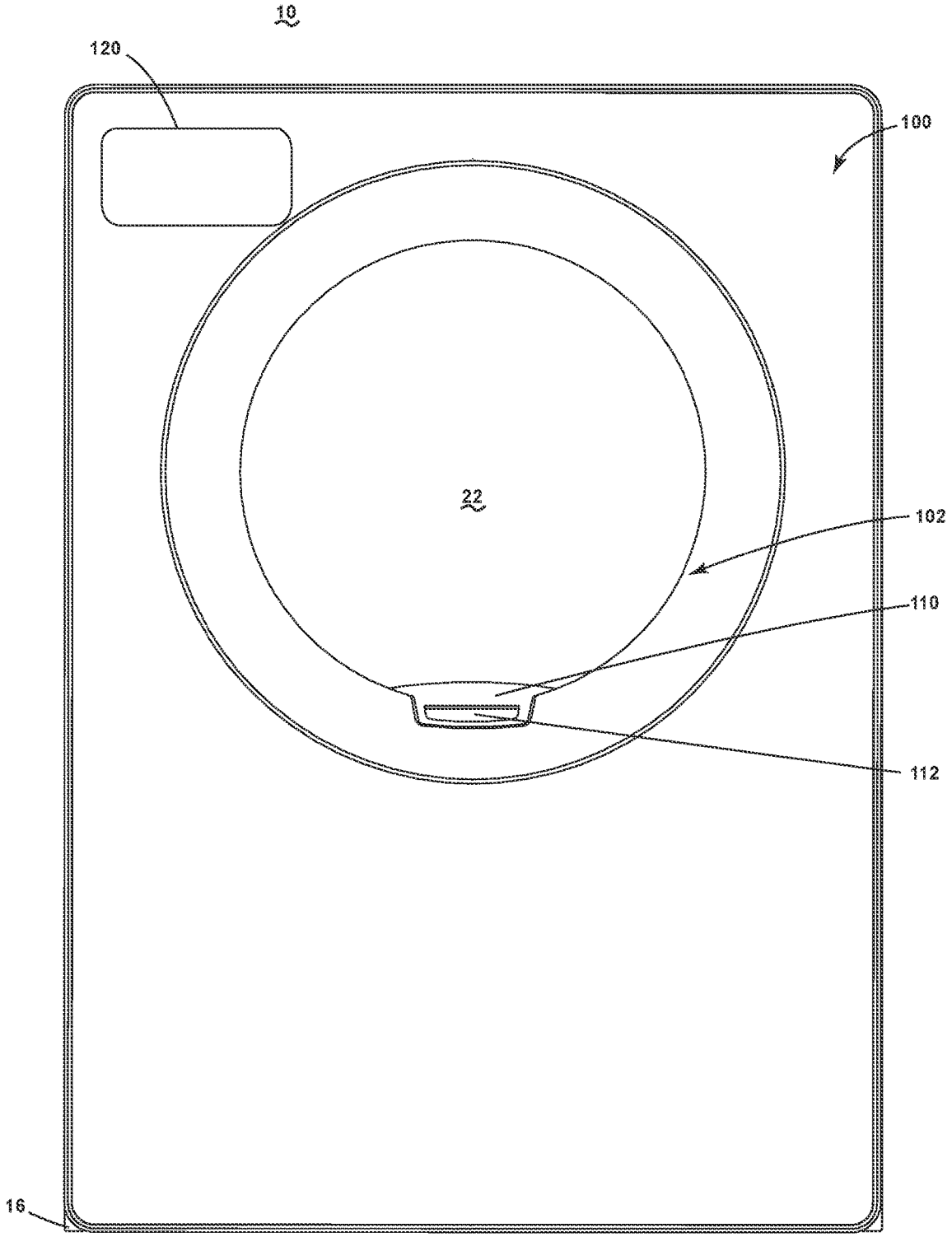
FIG. 5 is a front view of the laundry treating appliance of FIG. 4 with the window in a lowered position.

FIG. 5 illustrates a front view of the laundry treating appliance 10 with the door assembly 100 in the closed condition and the window panel 110 in the lowered position such that the access opening 102 is opened and user access to the front panel opening 18 and the treating chamber 22 is permitted. When the window panel 110 is in the lowered position, the window panel 110 can be at least partially received within an interior of the door assembly 100, though it will be understood that the window panel 110 could be lowered in between the door assembly 100 and the front panel 16, rather than within the interior of the door assembly 100. While the window panel 110 is illustrated herein as having a raised position and a lowered position, it will be understood that the window panel 110 can also be raised or lowered to a point between the raised position and the lowered position and can be stopped at any desired point at or between the raised and lowered positions. In one example, the window panel 110 or the door assembly 100 can include a counterweighting mechanism such that the user can have a weightless experience when raising or lowering the window panel 110.

The sliding of the window panel 110 can be implemented in any suitable manner, including that the window panel 110 can be manually moved, or that an actuator (not shown) can be provided and configured to automatically move the window panel 110 between raised and lowered positions by way of operable coupling with the controller 58. The actuator can move the window panel 110 toward the raised or lowered position in response to user input or in response to input from the controller 58 of the laundry treating appliance 10. Any suitable type of actuator could be coupled with the window panel 110, non-limiting examples of which include a motor or a biasing device, such as a spring.

Figure 6:
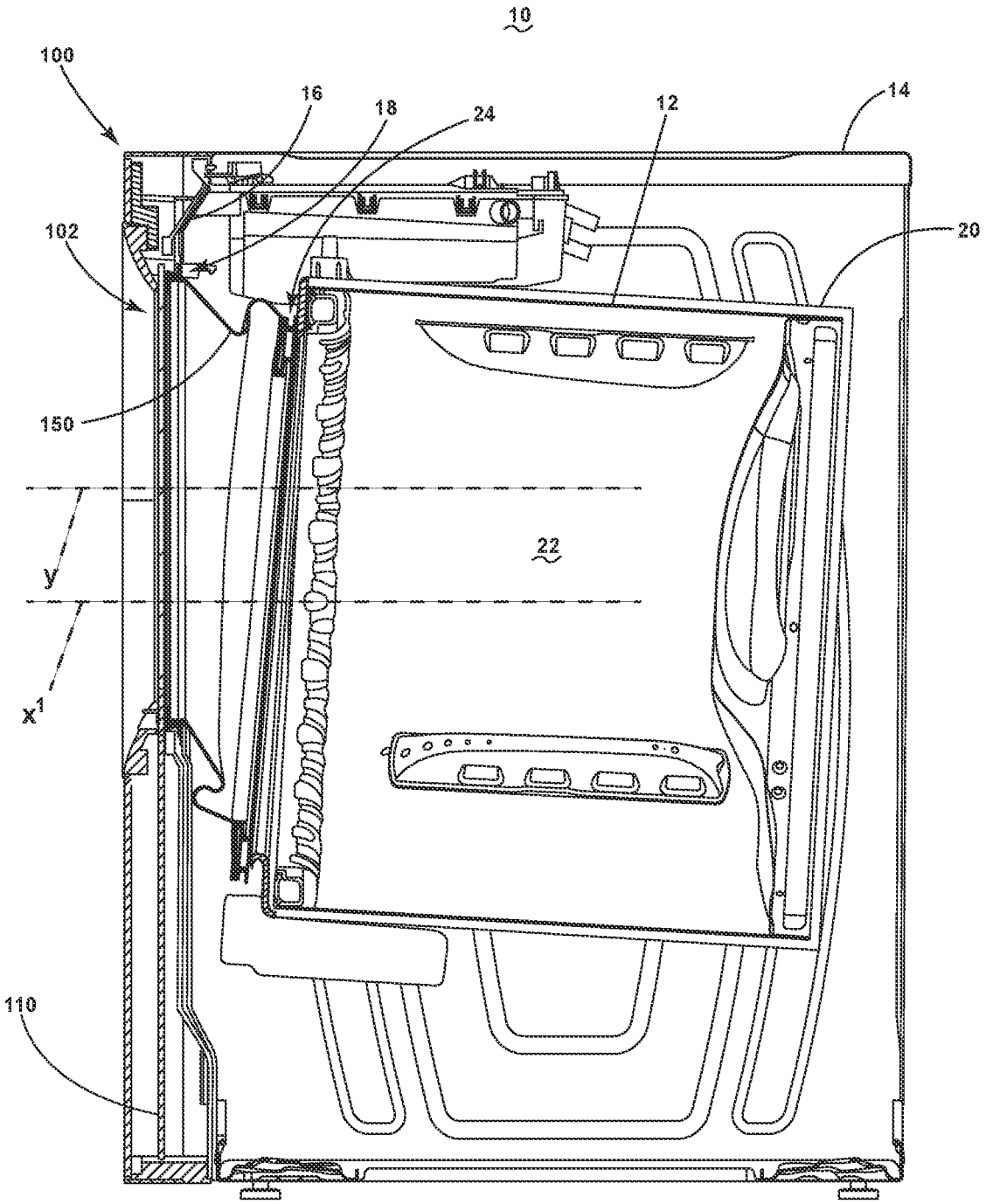
FIG. 6 is a side cross-sectional view of the laundry treating appliance including an angled bellows.

FIG. 6 illustrates a cross-sectional view of the laundry treating appliance 10 including another example of a bellows 50, illustrated herein as an oblique or angled bellows 150. In this example, a vertical offset is provided between the front panel opening 18 and the tub opening 24 such that a tub axis X' is defined by the tub 20 and the tub opening 24 and a panel axis Y is defined by the front panel opening 18, and the axes X' and Y are no longer aligned and are not coaxial as with the common axis X. For example, the front panel opening 18 can be provided at a higher position within the front panel 16 as compared to the previous example, while the tub opening 24 remains at the same height relative to the front panel 16 and is still accessible through the front panel opening 18. Thus, the angled bellows 150 must extend between the front panel opening 18 and the tub opening 24 to form an angled profile. In one example, the front panel opening 18 can be raised three to four inches vertically above the tub opening 24. As illustrated herein, the angled bellows 150 can have an S-shaped profile. However, it will be understood that the angled bellows 150 need not be S-shaped, but could rather be substantially flat or uniform, as in the case of the bellows 50. The S-shaped angled bellows 150 can prevent laundry items from becoming trapped or stuck within the angled bellows 150.

By vertically shifting the front panel opening 18 and the access opening 102 upwardly relative to the tub 20, the user's view to the rear and the bottom of the treating chamber 22 is improved. Further, the upward shift of the access opening 102 allows a greater height within which the window panel 110 can slide downward within the door assembly 100, allowing the window panel 110 to slide downward and be completely received within the door assembly 100 to the extent that the handle 112 is still accessible to the user. If the access opening 102 were not shifted upward, the portion of the door assembly 100 may not have a height sufficient for the window panel 110 to slide downward completely within the door assembly 100, resulting in a portion of the window panel 110 partially blocking the access opening 102 and creating an inconvenience for the user. Further still, the angled bellows 150 can obviate the need for a bowl portion of the door window as is seen in conventional laundry treating appliances such as washing machines. The bowl portion can be provided to prevent laundry items from becoming stuck on the bellows 150 or from applying pressure against the door assembly 100. When the access opening 102 and front panel opening 18 are vertically shifted upward relative to the tub opening 24, the bowl portion may no longer be needed as the angle of the angled bellows 150 can be sufficient to encourage laundry items to fall back toward the treating chamber 22 due to gravity alone.

Figure 7:
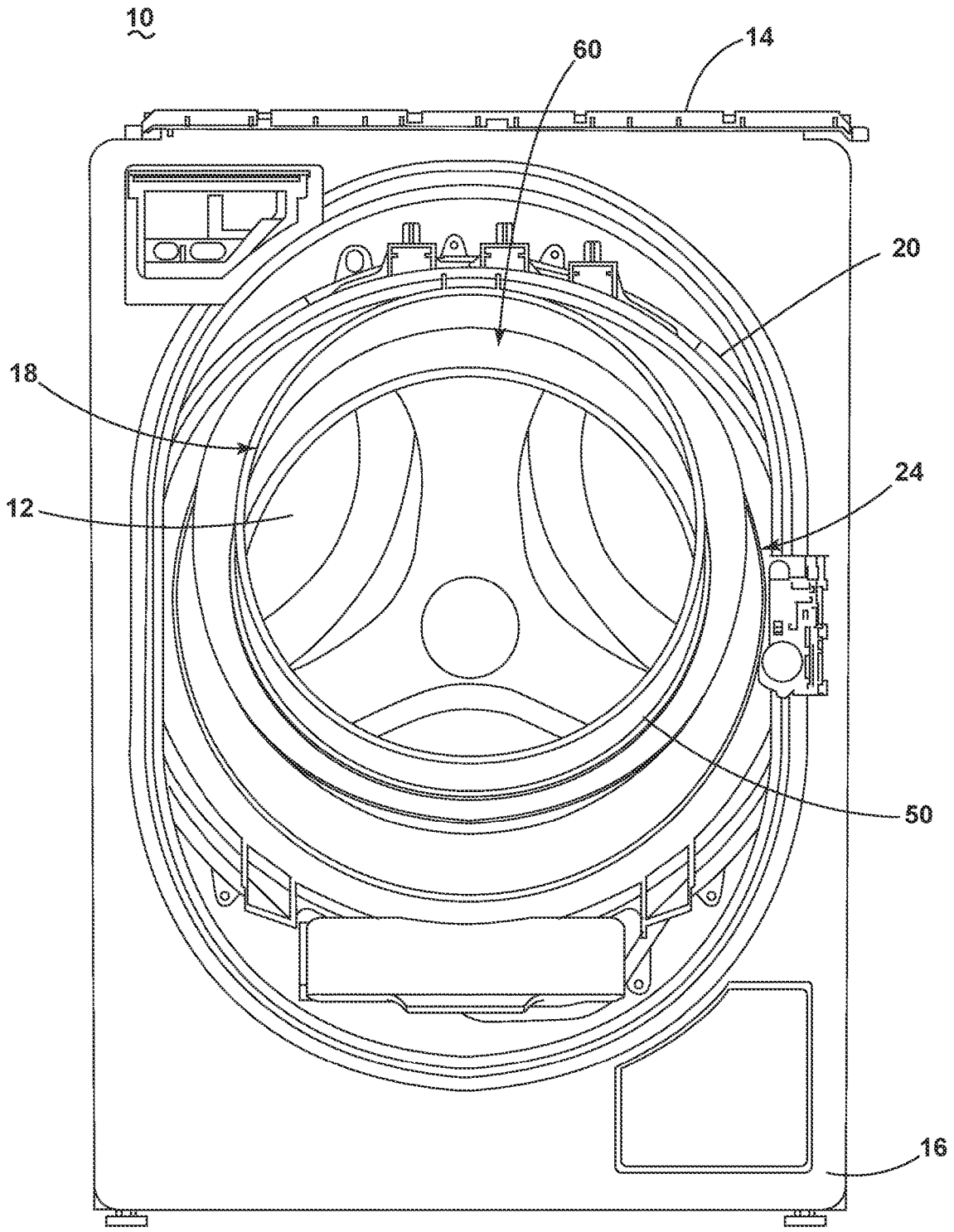
FIG. 7 is a front view of the laundry treating appliance with the door assembly and front panel removed and having an angled bellows.

FIG. 7 illustrates a front view of the laundry treating appliance 10 with the door assembly 100 and front panel 16 removed so that the angle of the bellows 50 can be seen. It will be understood that the profile shape of the bellows 50 can be any suitable shape, including the previously described shapes, non-limiting examples of which include a sloped bellows, an S-shaped bellows, or a corrugated bellows, so long as the bellows 50 extends between two vertically offset openings. While the bellows 50 is illustrated herein as having a circular front panel opening 18 that is the same size as the tub opening 24, it will be understood that the bellows 50 can have a front panel opening 18 in any suitable or desired shape, non-limiting examples of which include a circle that is larger than the tub opening 24, a D-shaped opening, a sideways D-shaped opening, a square opening, a square opening with rounded corners, or an oval opening. Such varying shapes can be selected to optimize ease of loading laundry items into the treating chamber 22, as well as improving the view of a user into the treating chamber 22.

The bellows 50 can further define a visual portion 60 that faces towards and is viewable by the user. As the bellows 50 angles downwardly from the front panel opening 18 to the tub opening 24, the bellows 50 defines the visual portion 60 at an upper portion of the bellows 50 that is visible to the user. The visual portion 60 can be used to provide a pleasing visual effect to the user, such as a decorative pattern. Such a decorative pattern can be formed in the bellows 50 in a three-dimensional manner, or provided as a decorative panel, printed applique, wrapper, or insert to couple to the visual portion 60 of the bellows 50. Warning labels, safety labels, or other user instructions could also be provided on the visual portion 60.

Figure 8:
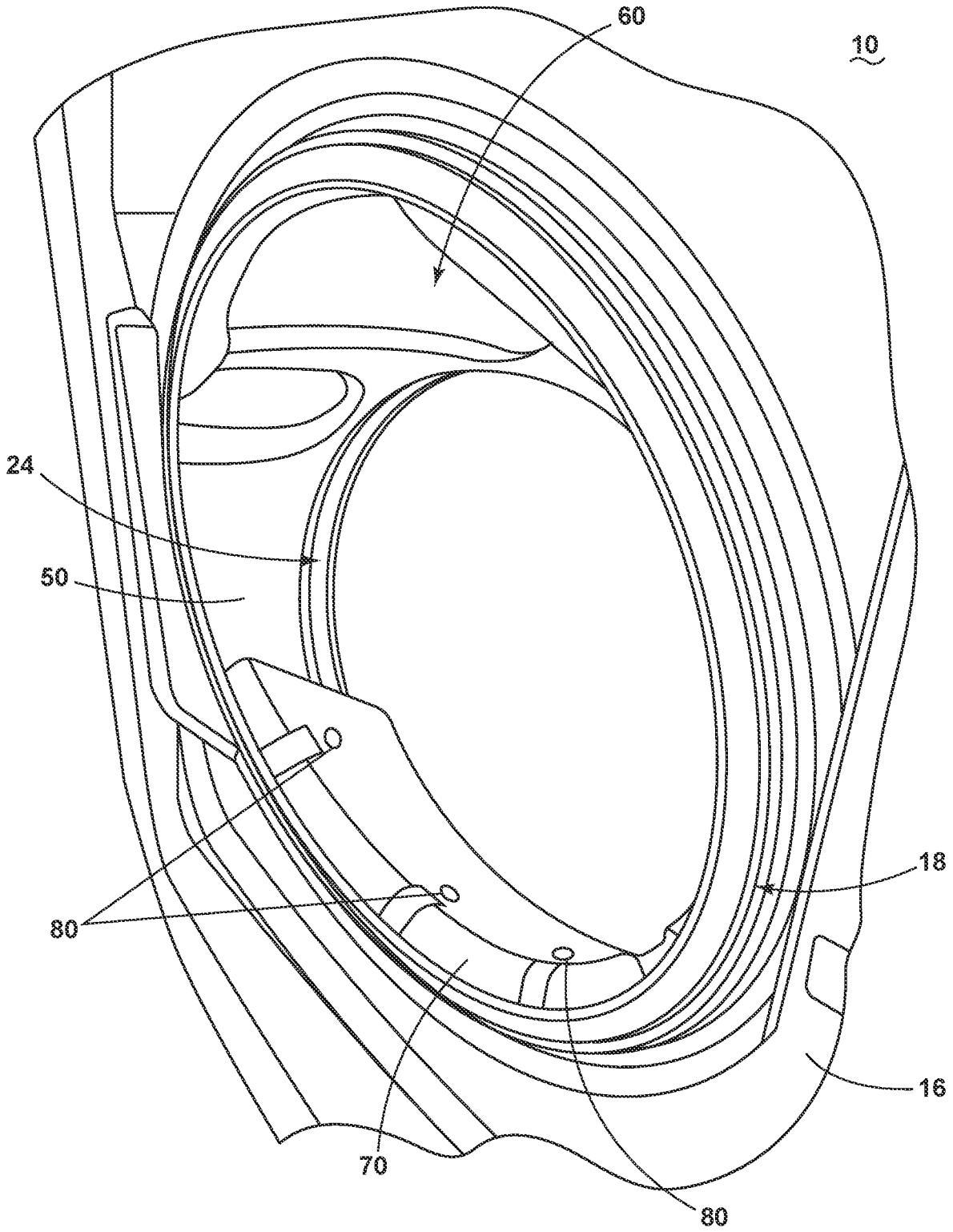
FIG. 8 is a perspective view of the laundry treating appliance with the door assembly removed and having the angled bellows and a bellows deflecting element.

FIG. 8 illustrates a perspective view of the laundry treating appliance 10 with the door assembly 100 removed. While the visual portion 60 can still be seen, a deflecting element 70 is also provided. The deflecting element 70 can be provided with the angled bellows 50 in order to deflect laundry items away from the bellows 50. Since a bowl portion is not provided with the door assembly 100, the deflecting element 70 can instead be used to direct laundry items away from the bellows 50. This can further ensure that laundry items do not become trapped within the bellows 50, as well as preventing damage to the bellows 50 from laundry items that may otherwise sit on the bellows 50 and cause damage to the material of the bellows 50.

The bellows 50 can be formed from a flexible or pliable material, such as a rubber. In one example, the deflecting element 70 can be formed from a material that is more rigid than the material of the bellows 50. It will be understood that the deflecting element 70 can be formed from a material that is either rigid or non-rigid, such as flexible, so long as the material of the deflecting element 70 has sufficient strength to withstand an impact of wet laundry items that may be traveling at high speeds, such as at spin speeds during a spin phase of the cycle of operation. Further, the deflecting element 70 can be formed of or coated on an outer surface with a material having a low coefficient of friction, such as a coefficient of friction lower than that of the bellows 50, in order to further encourage laundry items to slide along the angled bellows 50 and back into the treating chamber 22, rather than resting on or becoming stuck within or to the bellows 50. By way of non-limiting example, the deflecting element 70 can be formed of marine grade foamed vinyl or a polyvinyl chloride (PVC)-coated closed cell foam. While the deflecting element 70 is illustrated herein as being provided along a lower portion of the bellows 50, it will be understood that the deflecting element 70 can be provided along any suitable portion of the bellows 50, non-limiting examples of which include the entire lower half of the bellows 50, or about the entire circumference of the bellows 50.

A set of spray outlets 80 can optionally be provided within the deflecting element 70, which can include any suitable number of spray outlets 80, including only a single spray outlet 80. Any of the previously described spray nozzles 39, dispensing nozzle 41, or the recirculation inlet 48 can be provided within or passing through the deflecting element 70, or the spray outlets 80 provided within or passing through the deflecting element 70 can be separate spray outlets 80 that are fluidly coupled with the liquid supply system. Alternately, or in addition to, the spray outlets 80, at least one light can be provided within or along the deflecting element 70. The light can be provided as, by way of non-limiting example, an LED bulb protruding from or embedded within the deflecting element 70, or an edge lighting array along an edge of the deflecting element 70. It will be further understood that, in aspects of the present disclosure wherein the deflecting element 70 is not included, either or both of the light or spray outlets 80 can be provided directly in the bellows 50, rather than in the deflecting element 70.

Figure 9:
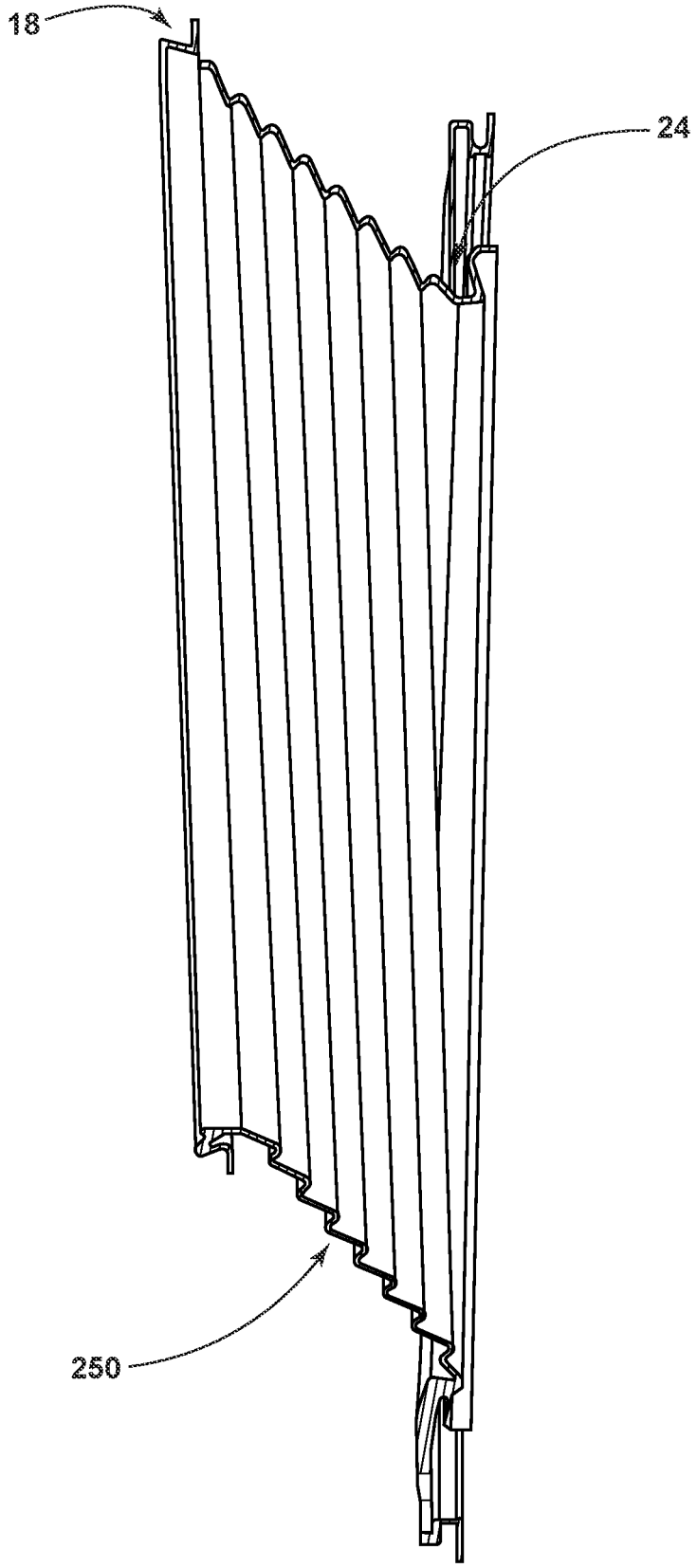
FIG. 9 is a side view of another angled bellows that can be used with the laundry treating appliance.

FIG. 9 illustrates another example of an angled bellows 250 that can be used within the laundry treating appliance 10. In this example, the front panel opening 18 is still vertically shifted upward relative to the tub opening 24. However, rather than having a flat surface or an S-shaped profile, in this example, the angled bellows 250 has a corrugated profile extending between the tub opening 24 and the front panel opening 18.

The aspects of the present disclosure provide a laundry treating appliance having a variety of features providing benefits to the user. In one example, a slidable window is provided such that a user can load laundry into the treating chamber via the slidable window. Along with the slidable window, a hinged door assembly can be provided so that the laundry treating appliance will still meet UL safety standards for entrapment by having a hinged door that can be kicked or pushed open, while allowing normal laundry loading to occur through a slidable window. Further, the hinged door assembly allows the user to clean the rear or inner surface of the slidable window without having to try to reach through the partially opened slidable window to do so. Further still, the access opening can be vertically upwardly offset relative to the opening of the tub, with or without an angled bellows extending between the vertically offset openings. The angled bellows can encourage laundry items to slide downwardly off of the angled bellows and back into the treating chamber without the need for an inwardly protruding bowl associated with the slidable window and while improving user visibility into the treating chamber, in particular to the lower rear portions of the treating chamber. By encouraging laundry items to slide along the angled bellows rather than becoming stuck on or in the bellows, standing water in the bellows that can result in an unpleasant odor can also be avoided. In the case that a bellows is not included with the vertically offset openings, improved visibility to the treating chamber is still achieved, as well as providing the room necessary for the window panel to be lowered all the way to the lowered position within the door assembly, as well as allowing for matched styling between the window panel height of, for example, a washing machine with an angled bellows and a clothes dryer with vertically offset openings, but no bellows.

To the extent not already described, the different features and structures of the various aspects of the present disclosure can be used in combination with each other as desired. That one feature may not be illustrated in all of the aspects of the disclosure is not meant to be construed that it cannot be, but is done for brevity of description. For example, the slidable window panel can be employed with or without the angled bellows and the vertically offset access opening, spray outlets and nozzles can be provided with or without an angled bellows or a deflecting element, or the angled bellows and vertically offset access opening can be provided with or without the slidable window and/or the hinged door assembly. Thus, the various features of the different aspects of the present disclosure can be mixed and matched as desired to form new aspects, whether or not the new aspects are expressly described. All combinations or permutations of features described herein are covered by this disclosure.

While the present disclosure has been specifically described in connection with certain specific aspects thereof, it is to be understood that this is by way of illustration and not of limitation. Reasonable variation and modification are possible within the scope of the forgoing disclosure and drawings without departing from the spirit of the present disclosure. Hence, specific dimensions and other physical characteristics relating to the aspects of the present disclosure are not to be considered as limiting, unless expressly stated otherwise.

What is claimed is:

1. A laundry treating appliance, comprising:

a chassis defining an interior and having a front panel defining a front panel opening;

a rotatable treating chamber located within the interior and having a treating chamber opening at a lower height than the front panel opening, yet still accessible through the front panel opening; and a door assembly mounted to the chassis for movement between an opened position and a closed positions to selectively open or close the front panel opening, the door assembly comprising a window aligned with the front panel opening when the door assembly is in the closed position, and the window is slidable between a closed position, where it closes the front panel opening, and an opened position, where it provides access to an entirety of the front panel opening.

2. The laundry treating appliance of claim 1 wherein the window is configured to selectively allow access to the treating chamber when the door assembly is in the closed position.

3. The laundry treating appliance of claim 1 wherein the door assembly is hingedly mounted to the chassis for movement between the opened position and the closed positions.

4. The laundry treating appliance of claim 1 wherein the door assembly further comprises a front fascia and is coextensive with the front panel of the chassis.

5. The laundry treating appliance of claim 1 wherein the window is aligned with the entirety of the front panel opening when the window is in the closed position.

6. The laundry treating appliance of claim 1 wherein a closure mechanism resiliently retains the door assembly in the closed position relative to the front panel and the door assembly moves from the closed position to the opened position when sufficient force is applied to overcome a coupling of the closure mechanism.

7. The laundry treating appliance of claim 1, further comprising a tub located within the interior and receiving the rotatable treating chamber, the tub defining a tub opening allowing access to the treating chamber.

8. The laundry treating appliance of claim 7 wherein a bellows extends between and couples the tub opening and the front panel opening.

9. The laundry treating appliance of claim 8 wherein the door assembly seals against at least one of the front panel opening and the bellows.

10. The laundry treating appliance of claim 9 wherein the window seals against the at least one of the front panel opening and the bellows.

11. The laundry treating appliance of claim 7 wherein the front panel opening and the tub opening are vertically offset.

12. The laundry treating appliance of claim 11 wherein the front panel opening is raised vertically relative to the tub opening.

13. The laundry treating appliance of claim 12 wherein an angled bellows extends between the vertically offset tub opening and front panel opening.

14. The laundry treating appliance of claim 13 wherein an upper portion of the angled bellows defines a visual portion including at least one of a decorative pattern, a label, or instructions for a user.

15. The laundry treating appliance of claim 13, further comprising a deflecting element provided on at least a portion of the angled bellows and having a rigidity greater than the rigidity of the angled bellows.

16. The laundry treating appliance of claim 15 wherein an outer surface of the deflecting element has a lower coefficient of friction than the angled bellows.

17. The laundry treating appliance of claim 15 wherein the deflecting element includes at least one spray outlet.

18. A laundry treating appliance, comprising:

a chassis defining an interior and having a front panel defining a front panel opening;

a rotatable treating chamber located within the interior and having a treating chamber opening at a lower height than the front panel opening, yet still accessible through the front panel opening; and a door assembly mounted to the chassis for movement between an opened position and a closed positions to selectively open or close the front panel opening, the door assembly comprising a window aligned with the front panel opening when the door assembly is in the closed position, and the window is vertically slidable between a closed position, where the window is in a raised position and the window closes the front panel opening, and an opened position, where the window is in a lowered position where the window is at least partially received within an interior of the door assembly or the window is at least partially between the door assembly and the front panel and where the window provides access to the front panel opening.

19. The laundry treating appliance of claim 18 wherein the door assembly further comprises a front fascia and is coextensive with the front panel of the chassis.

20. The laundry treating appliance of claim 18 wherein a closure mechanism resiliently retains the door assembly in the closed position relative to the front panel and the door assembly moves from the closed position to the opened position when sufficient force is applied to overcome a coupling of the closure mechanism.

* * * * *